US012624923B2

(12) United States Patent
Hamer

(10) Patent No.: US 12,624,923 B2
(45) Date of Patent: May 12, 2026

(54) CONTROLLER FOR AND METHOD OF CONTROLLING A COUNTER MEASURE SYSTEM

(71) Applicant: STEELROCK TECHNOLOGIES LTD, London (GB)

(72) Inventor: Christopher Howard Hamer, Usk (GB)

(73) Assignee: STEELROCK TECHNOLOGIES LTD, London (GB)

( * ) Notice: Subject to any disclaimer, the term of this patent is extended or adjusted under 35 U.S.C. 154(b) by 334 days.

(21) Appl. No.: 18/004,809

(22) PCT Filed: Jul. 13, 2021

(86) PCT No.: PCT/GB2021/051789
§ 371 (c)(1),
(2) Date: Jan. 9, 2023

(87) PCT Pub. No.: WO2022/013539
PCT Pub. Date: Jan. 20, 2022

(65) Prior Publication Data

US 2023/0243620 A1 Aug. 3, 2023

(30) Foreign Application Priority Data

Jul. 13, 2020 (GB) ..... 2010764

(51) Int. Cl.
*F41G 3/00* (2006.01)
*F41G 3/04* (2006.01)
*F41H 13/00* (2006.01)

(52) U.S. Cl.
CPC ..... *F41G 3/04* (2013.01); *F41H 13/0043* (2013.01)

(58) Field of Classification Search
CPC ..... F41G 3/04; F41H 13/0043; H04K 3/42; H04K 3/45; H04K 3/43; H04K 2203/22;
(Continued)

(56) References Cited

U.S. PATENT DOCUMENTS 7,773,204 B1 * 8/2010 Nelson ..... G01S 13/48 356/5.02
9,523,773 B2 * 12/2016 Fink ..... G01S 19/215
(Continued)

FOREIGN PATENT DOCUMENTS

CN 106291592 A 1/2017
CN 107656543 A 2/2018
(Continued)

OTHER PUBLICATIONS

Great Britain Search Report for Corresponding Application Serial No. GB 2010764.5, Dated Dec. 18, 2020.
(Continued)

*Primary Examiner* — Peter D Nolan
*Assistant Examiner* — Peter Y Ning
(74) *Attorney, Agent, or Firm* — Tarolli, Sundheim, Covell & Tummino LLP

(57) ABSTRACT

A controller for a counter measure system against unmanned aerial vehicles (UAVs) includes a display device and a processor configured to receive target position data of a target UAV, effector position data of at least one counter measure effector, and effector orientation data of the at least one counter measure effector relative to geographic cardinal directions. The processor is also configured to determine a field of effect of the at least one counter measure effector on the basis of the effector position data and the effector orientation data. The field of effect is indicative of an area covered by electromagnetic radiation emitted, in use, by the at least one counter measure effector. The processor is
(Continued)

further configured to generate a display signal for displaying, on the display device, the position of the target UAV with respect to the field of effect of the at least one counter measure effector.

18 Claims, 5 Drawing Sheets

(58) Field of Classification Search
CPC ..... H04K 2203/34; H04K 3/90; H04K 3/92; H04K 3/94; H04K 3/82; H04K 2203/10; B64C 39/024
See application file for complete search history.

(56) References Cited

U.S. PATENT DOCUMENTS

| | | | | |
|---|---|---|---|---|
| 9,715,009 | B1 * | 7/2017 | Parker | G01S 13/88 |
| 10,567,107 | B2 * | 2/2020 | Morrow | H04K 3/65 |
| 10,574,384 | B2 * | 2/2020 | Morrow | G08B 6/00 |
| 10,585,189 | B1 * | 3/2020 | Dove | G01S 13/951 |
| 11,187,499 | B1 * | 11/2021 | Fortney | H04K 3/45 |
| 11,385,341 | B2 * | 7/2022 | Massarik | H04B 7/0621 |
| 11,487,016 | B2 * | 11/2022 | Sundaramurthy | G08G 5/0091 |
| 11,488,385 | B2 * | 11/2022 | Morrow | G06V 20/13 |
| 11,578,952 | B2 * | 2/2023 | Fortney | H04K 3/42 |
| 11,675,353 | B2 * | 6/2023 | Bullock | H04K 3/41 701/3 |
| 12,038,500 | B2 * | 7/2024 | Teague | G01S 13/953 |
| 2012/0212363 | A1 * | 8/2012 | Brasile | F41H 13/0075 342/14 |
| 2021/0116558 | A1 * | 4/2021 | Chan | G08G 3/00 |

FOREIGN PATENT DOCUMENTS

| | | | | |
|---|---|---|---|---|
| CN | 108880735 A | * | 11/2018 | H04K 3/40 |
| GB | 2536043 A | | 9/2016 | |

OTHER PUBLICATIONS

International Search Report and Written Opinion dated Oct. 22, 2021 for Corresponding Application Serial No. PCT/GB2021/051789, pp. 1-10.

* cited by examiner

CONTROLLER FOR AND METHOD OF CONTROLLING A COUNTER MEASURE SYSTEM

RELATED APPLICATIONS

The present application is a U.S. National Stage application under 35 USC 371 of PCT Application Serial No. PCT/GB2021/051789, filed on 13 Jul. 2021; which claims priority from GB Patent Application No. 2010764.5, filed 13 Jul. 2020, the entirety of each of which are incorporated herein by reference.

BACKGROUND OF THE INVENTION

The present disclosure relates to a controller for and a method of controlling a counter measure system, particularly but not exclusively, a counter measure system against unmanned aerial vehicles. Other aspects of the present disclosure relate to a counter measure system.

Unmanned vehicles, particularly unmanned aerial vehicles (UAV), are an increasingly common sight. Mostly civil in nature, these UAVs are typically harmless to the public. Examples include drones for aerial building observation or even delivery drones that have recently been tested by shipping companies. However, occasionally even such commercial, "off the shelf" drones are used by individuals or companies for industrial espionage to obtain confidential information from their competitors, as well as for other nefarious purposes. Other types of UAVs are used for military purposes, such as spying missions or even performing physical attacks on foreign territory. Military grade UAVs can be dangerous not only for military personnel but also for civilian life.

In view of the above, counter measure system are known that may be used to neutralise threats caused by UAVs. Such counter measure systems typically include one or more counter measure effectors (also known as jammers) configured to emit electromagnetic radiation towards UAVs. Such counter measure effectors can be used to take over control and/or disable unauthorised UAVs.

Traditional counter measure effectors are standalone devices carried by a field operator and pointed in the direction of a UAV for neutralisation. If large areas have to be secured against unauthorised entry of UAVs, it is not uncommon to deploy a plurality of counter measure effectors, each carried by a different operator. However, said operators are currently typically in a situation in which they have to decide single-handedly how to act against one or more UAVs in their area. This can lead to ineffective management of the situation, particularly where more than one counter measure effector is employed, with very limited information flowing to operational command (e.g. Gold Command) with which to help make decisions.

In view of the above, there is a need for improved systems and methods of controlling a counter measure system effectively.

It is an aim of the present invention to solve or at least ameliorate one or more problems of the prior art.

SUMMARY OF THE INVENTION

Aspects and embodiments of the disclosure provide a method of controlling a counter measure system and a controller for a counter measure system as claimed in the appended claims.

According to one aspect of the present disclosure, there is provided a controller for a counter measure system against unmanned aerial vehicles (UAVs), the controller comprising a display device and a processor configured to:

- receive target position data indicative of a position of a target UAV;
- receive effector position data indicative of a position of at least one counter measure effectors;
- receive effector orientation data indicative of an orientation of the at least one counter measure effector relative to geographic cardinal directions;
- determine a field of effect of the at least one counter measure effector on the basis of the effector position data and the effector orientation data, said field of effect being indicative of an area covered by electromagnetic radiation emitted, in use, by the at least one counter measure effector; and,
- generate a display signal for displaying, on the display device, the position of the target UAV with respect to the field of effect of the at least one counter measure effector.

In another embodiment, the processor is configured to:

- receive one or more command signals representative of a desired action to be taken by an operator of the at least one counter measure effector;
- generate, on the basis of the one or more command signals, a display signal for displaying, on the display device, the desired action.

In another embodiment, the command signals comprise user input provided by a user of the controller.

In another embodiment, the one or more command signals comprise one or more of:

- effector frequency data representative of a desired frequency band to be emitted by the at least one effector in response the target UAV;
- effector displacement data representative of a desired change in location and/or orientation of the at least one counter measure effector; and
- effector activation data representative of a desire to activate the at least one counter measure effector.

In another embodiment, the processor is configured to:

- receive effector position data and effector orientation data of a plurality of counter measure effectors;
- determine a field of effect for each of the counter measure effectors on the basis of their respective effector position data and the effector orientation data;
- generate a display signal for displaying, on the display device, the position of the target UAV with respect to the fields of effect of the plurality of counter measure effectors.

In another embodiment, the processor is configured to:

- determine the counter measure effector that is most suitable for taking action against the target UAV; and
- generate a display signal for displaying, on the display device, the most suitable counter measure effector.

In another embodiment, the processor is configured to:

- receive target frequency data indicative of a communicating frequency used by the target UAV;
- determine, on the basis of the target frequency data, a suitable frequency band to be emitted by the counter measure effector when activated;
- generate a display signal for displaying, on the display device, the suitable frequency band.

In another embodiment, the processor is configured to:

- receive counter effector frequency range data representative of frequency bands available to be emitted by the counter measure effector;

compare one or more values of the target frequency data with each of the frequency bands;

determine, on the basis of a comparison result, a suitable frequency band to be emitted by the counter measure effector when activated.

In another embodiment, the processor is configured to determine a control signal for automatically setting the frequency of the counter measure effector to the suitable frequency band.

In another embodiment, the display device comprises a display arranged in command office located remotely from the at least one counter measure effector and/or wherein the display device comprises a mobile display carried by an operator of the counter measure effector.

In another embodiment, the controller is configured to:

receive environmental data representative of characteristics of an urban and/or natural environment;

generate, on the basis of the target position data and the environmental data, a display signal for displaying, on the display device, environmental data surrounding the target UAV;

In another embodiment, the environmental data comprises one or more of:

elevation data representative of ground elevations;

wind data representative of wind speeds;

building data representative of type and/or location and/or dimensions of buildings;

civilian position data representative of the presence of civilians.

In another embodiment, the controller is configured to:

determine, on the basis of the environmental data, one or more no-drop zones representative of areas surrounding the target UAV in which a drop/landing of the target UAV could cause damage to structures or human health; and generate a display signal for displaying, on the display device, the one or more no-drop zones.

In another embodiment, the controller is configured to:

determine, on the basis of the environmental data and the target position data, a drop location representative of a predicted location to which the target UAV will drop when being disabled by the at least one counter measure effector; and generate a display signal for displaying, on the display device, the drop location.

In another embodiment, the controller is configured to:

compare the drop location with the one or more no-drop zones;

determine a drop warning signal if the drop location falls within one of the one or more no-drop zones;

generate a display signal for displaying, on the display device, the drop warning signal.

In another embodiment, the controller is configured to:

compare the drop location with the one or more no-drop zones; and temporarily deactivate the at least one counter measure effector and/or warn the operator if the drop location falls within one of the one or more no-drop zones.

In another embodiment, the controller is configured to:

determine, on the basis of the environmental data, one or more no-jam zones representative of areas surrounding the target UAV which should not be subjected to electromagnetic radiation emitted, in use, by the at least one counter measure effector; and generate a display signal for displaying, on the display device, the one or more no-jam zones.

In another embodiment, the controller is configured to:

correlate the environmental data with the field of effect of the at least one counter measure effector;

determine an interference warning signal if the field of effect of the at least one counter measure effector intersects within one of the one or more no-jam zones; and generate a display signal for displaying, on the display device, the interference warning signal.

In another embodiment, the controller is configured to:

correlate the environmental data with the field of effect of the at least one counter measure effector; and temporarily deactivate the at least one counter measure effector and/or warn the operator if the field of effect of the at least one counter measure effector intersects with one of the one or more no-jam zones.

In another embodiment, the controller is configured to:

determine an actuation signal if the target UAV is within the field of effect of the at least one counter measure actuator; and provide the actuation signal to the at least one counter measure effector for actuating emission of electromagnetic radiation towards the target UAV.

According to another aspect of the present disclosure, there is provided a counter measure system comprising any of the above controllers and one or more counter measure effectors, the or each counter measure effectors comprising:

an electromagnetic emitter for emitting electromagnetic radiation;

a location sensor for determining the position data;

an orientation sensor for determining the orientation data; and, a communications module for transmitting the location data and the orientation data to the controller.

According to another aspect of the present disclosure, there is provided a method of controlling a counter measure system against unmanned aerial vehicles (UAVs), the method comprising:

receiving target position data indicative of a position of a target UAV;

receiving effector position data indicative of a position of at least one counter measure effectors;

receiving effector orientation data indicative of an orientation of the at least one counter measure effector relative to geographic cardinal directions;

determining a field of effect of the at least one counter measure effector on the basis of the effector position data and the effector orientation data, said field of effect being indicative of an area covered by electromagnetic radiation emitted, in use, by the at least one counter measure effector; and, displaying, on a display device, the position of the target UAV with respect to the field of effect of the at least one counter measure effector.

According to another aspect of the present disclosure, there is provided a controller for a counter measure system against unmanned aerial vehicles (UAVs), the controller being configured to:

receive target position data indicative of a position of a target UAV;

receive effector position data indicative of a position of at least one counter measure effectors;

receive effector orientation data indicative of an orientation of the at least one counter measure effector relative to geographic cardinal directions;

determine a field of effect of the at least one counter measure effector on the basis of the effector position data and the effector orientation data, said field of effect being indicative of an area covered by electromagnetic radiation emitted, in use, by the at least one counter measure effector; and, generate a display signal for displaying, on a display device, the position of the target UAV with respect to the field of effect of the at least one counter measure effector.

According to another aspect of the present disclosure, there is provided a controller for a counter measure system against unmanned aerial vehicles (UAVs), the controller being configured to:

receive effector position data indicative of a position of at least one counter measure effectors;

receive environmental data representative of characteristics of an urban and/or natural environment;

determine, on the basis of the environmental data, one or more no-jam zones representative of areas surrounding the position of the at least one counter measure effector that should not be subjected to electromagnetic radiation emitted, in use, by the at least one counter measure effector; and generate a display signal for displaying, on a display device, the one or more no-jam zones with respect to the position of the at least one counter measure effectors.

Within the scope of this application it is expressly intended that the various aspects, embodiments, examples and alternatives set out in the preceding paragraphs, and the claims and/or the following description and drawings, and in particular the individual features thereof, may be taken independently or in any combination. That is, all embodiments and all features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the present disclosure will now be described by way of example only, with reference to the accompanying drawings, in which.

DETAILED DESCRIPTION OF THE DRAWINGS

Figure 1:
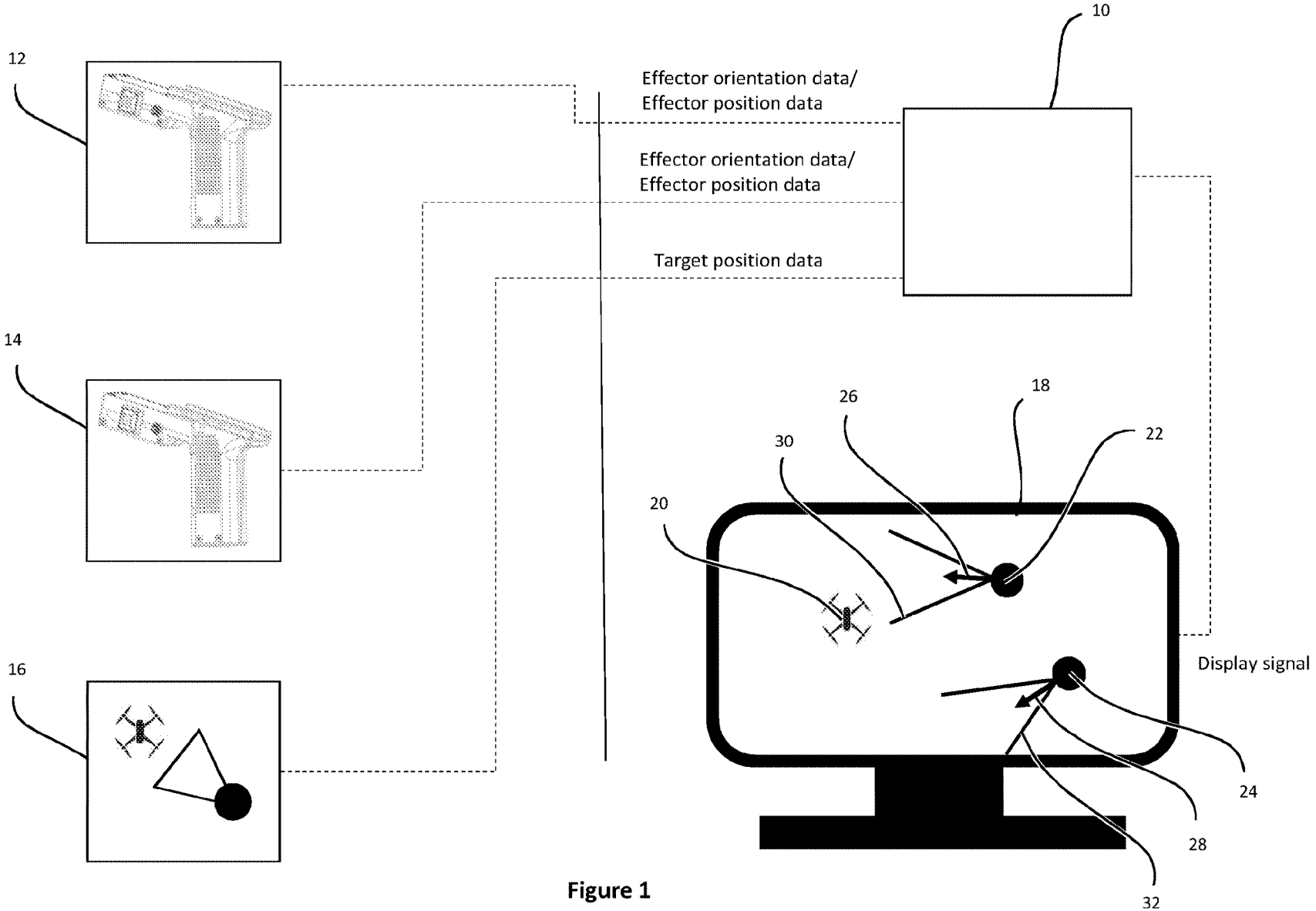
FIG. 1 shows an embodiment of the controller according to the present disclosure.

FIG. 1 shows a schematic representation of a controller according to an embodiment of the present disclosure. The controller 10 shown in FIG. 1 is a controller for a counter measure system against unmanned aerial vehicles such as drones.

Unmanned aerial vehicles, such as drones, can be a threat to both the privacy and wellbeing of individuals. Accordingly, in some scenarios it is desirable to deactivate and/or takeover control of unmanned aerial vehicles (UAV). To this end, it is known to utilise counter measure effectors, or sometimes also called jammers, which interfere with the remote control signal of the UAV. Rather than causing physical damage to the UAV, these counter measure effectors are capable of emitting an electromagnetic radiation that can deactivate or take over control of an unmanned vehicle. The electromagnetic radiation emitted by the counter measure effectors (or jammers) may disturb the remote control signals received by the UAV from the remote operator. Typically, the electromagnetic radiation emitted by such counter measure effectors are radio frequency electromagnetic waves.

In the example of FIG. 1, the controller 10 is in communication with two counter measure effectors, namely a first counter measure effector 12 and a second counter measure effector 14. Of course, it is equivalently possible that the controller 10 is in communication with only one or more than two counter measure effectors. The controller 10 may be a remote controller that is in wireless communication with the counter measure effectors 12, 14. In some embodiments however, each of the two countermeasure effectors 12, 14 may be connected to a separate controller, e.g. via a cable connection. Further still, one or both of the counter measure effectors may have built-in controllers, rather than or in addition to communicating with a centralised controller, such as the controller 10 shown in FIG. 1.

The controller 10 shown in FIG. 1 communicates with one or more target sensors. A first target sensor 16 is schematically represented in FIG. 1. The one or more target sensors communicating with the controller 10 may be adapted to determine a position of the target UAV, an operating frequency of the target UAV, and/or the type of UAV.

In one example, the first target sensor 16 may be an image sensor capable of providing images of the target UAV that can be used by the controller to determine the position of the target UAV and/or the type of UAV concerned. In other embodiments, the target sensor 16 may be a radio frequency sensor adapted to detect the operating frequency of the target UAV. The radio frequency sensor may also be able to provide triangulation data to the controller on the basis of which the controller may again determine the position of the target UAV.

It will be understood that the present disclosure is not limited to the type of target sensor used. Rather, any sensor suitable for determining relevant UAV data (i.e. the target position data) that may be used by the controller to determine the position of the target UAV may be used together with the controller of the present disclosure. Other examples may include radar or LIDAR systems.

The controller 10 comprises a processor configured to receive effector position data indicative of a position of at least one of the two counter measure effectors 12, 14. As will be described in more detail below, one example of such effector position data may be GPS coordinates of the respective counter measure effector. In the example of FIG. 1, effector position data is received by the processor of the controller 10 from both the first counter measure effector 12 and the second counter measure effector 14. On the basis of the effector position data received, the processor of the controller 10 of the embodiment shown in FIG. 1 is capable of determining the position of the first and second countermeasure effector 12, 14 within a coordinate system.

The processor of the controller 10 is further configured to receive effector orientation data indicative of an orientation of at least one of the counter measure effectors 12, 14 relative to geographic cardinal directions. This effector orientation data will enable the processor of the controller to determine the three-dimensional orientation of the respective counter-measure effector. In the embodiment of FIG. 1, the processer of the controller 10 receives effector orientation data from both the first and second counter measure effectors 12, 14. As will be described in more detail below, the effector position data may be yaw, role, and pitch measurements provided by a gyroscope integrated into the each of the two counter measure effectors 12, 14, for example. However, it is, of course, alternatively feasible to use any other type of orientation sensor suitable to provide data that will enable the processor the controller to determine the kind orientation of one of the counter measure effectors 12, 14.

The processor of the controller 10 is configured to receive target position data from the target sensor 16. As mentioned above, the target sensor 16 may be any sensor that is capable of determining the coordinates of the target UAV. In one example, the target sensor 16 may include a plurality of sensor devices that are configured to determine the location of the target UAV via triangulation.

The target position data is provided to the processor of the controller 10 in a form that allows the processor to determine the location of the target UAV with respect to a coordinate system and thus also with respect to the first and second counter measure effectors 12, 14.

The processor of the controller 10 may use the target position data and the effector position data to create a display signal for displaying, on a display 18, the positions of the counter measure effectors 12, 14 with respect to a target UAV, as schematically represented in FIG. 1. The processor of the controller 10 may display the locations of the target UAV and the counter measure effectors 12, 14 in a two-dimensional coordinate system that is displayed on the display 18. In FIG. 1, the displayed locations of the first and second counter measure effectors 12, 14 are referenced with labels 22 and 24, whereas the display representation of the location of the target UAV is referenced with label 20. Of course, it is also feasible for the processor of the controller to generate a three-dimensional display signal for displaying the locations 22, 24 of the counter measure effectors with respect to the location 20 of the target UAV in a three-dimensional space.

As will be described in more detail below, the two- or three-dimensional display signal generated by the processor may be overlaid with a corresponding two- or three-dimensional map of the surrounding area.

The processor of the controller 10 is configured to determine, on the basis of the effector position data and the effector orientation data that is received from the first and second counter measure effectors 12, 14, a field of effect for both counter measure effectors 12, 14. In particular, the processor of the controller 10 uses the effector position data to determine a starting point of a field of effect cone that represents an area covered by electromagnetic radiation emitted by the respective counter measure effector when in use. The processor may apply the effector orientation data in order to determine the direction in which the field of effect cone will extend.

In the example of FIG. 1, the processor of the controller 10 generates a display signal for displaying the location 22, 24, as well as orientations 26, 28 of the first and second counter measure effectors 12, 14. In the example of FIG. 1, the orientation 26, 28 of the first and second counter measure effectors 12, 14, are represented by arrows extending from a dot marking the location 22, 24 of the counter measure effectors 12, 14. The processor may centre the field of effect cone about an axis that is defined by the orientation 26, 28 of the counter measure effectors 12, 14.

In FIG. 1, the processor of the controller 10 has determined a field of effect for both counter measure effectors 12, 14 and generated a display signal for displaying the field of effect as two-dimensional cones on the display 18. A first field of effect cone 30 represents the field of effect of the first counter measure effector 12. A second field of effect cone 32 represents the field of effect of the second counter measure effector 14.

The size of the cone may be calculated by the processor on the basis of a type of counter measure effector used. It will be appreciated that different counter measure effectors may have varying emission ranges in distance and radial coverage. Some counter measure effectors may even be able to adjust their range and radial coverage and communicate this to the processor of the controller 10 for adjusting the field of effect within the display signal. In other words, the processor may determine, on the basis of the type and/or settings of a particular counter measure effector, the size and shape of the cone representing the field of effect of said counter measure effector, when in use. In the example FIG. 1, both counter measure effectors 12, 14 have a substantially identical field of effect and so the display signal generated by the processor includes identical field of effect cones 30, 32 that extend in different directions from different starting points. Although the illustration in FIG. 1 shows that the field of effect cones 30, 32 generated by the processor are two-dimensional, this is for simplification only and it should be appreciated that, in reality, the processor may be configured to generate a three-dimensional field of effect cones for both counter measure effectors 12, 14.

It will be understood that, although the field of effect of the counter measure effectors in this application are described as being cone-shaped, this is generally dependent on the type and setting of the counter measure effectors used. Accordingly, the present disclosure is not restricted to the particular shape of the field of effect cones 30, 32 depicted in the Figures.

The display 18 shown in FIG. 1 may be physically connected to the controller 10. Alternatively, the display 18 may be located remotely from the controller and connected to the controller wirelessly. In one embodiment, the display device 18 may be a mobile display, such as the screen of a tablet computer. In this embodiment, the operator of the first counter measure effector 12 may carry a display device, such as the display device 18. Similarly, the operator of the second counter measure effector 14 may carry another display device, such as the display device 18. In such an example, the display devices 18 may be mobile devices that can be used by the operators of the counter measure effectors to keep track of their relative position and orientation with respect to the target UAV. Of course, it is preferable for the processor to continuously update the display signal, such that the display devices represent live position and orientation data with a minimum of delay.

In another embodiment, the display device 18 shown in FIG. 1 may be a monitor located in a remote office (e.g. a Gold Command office). In this embodiment, the display device 18 may be viewed by command personnel overseeing a counter measure action against one or more target UAVs from a centralised location. The command personnel may be able to communicate with the operators of the counter measure effectors 12, 14 in various ways. In a more traditional approach, the command personnel may be connected to the operators of the first and second counter measure effectors 12, 14 via telephone or radio to instruct the counter measure effector operators with suitable actions. Preferably, however, the processor of the controller of the present disclosure is configured to provide commands from the centralised command office to the operators in the form of command data. The command data is representative of a desired action to be taken by an operator of the first and/or second counter measure effectors 12, 14.

Figure 2:
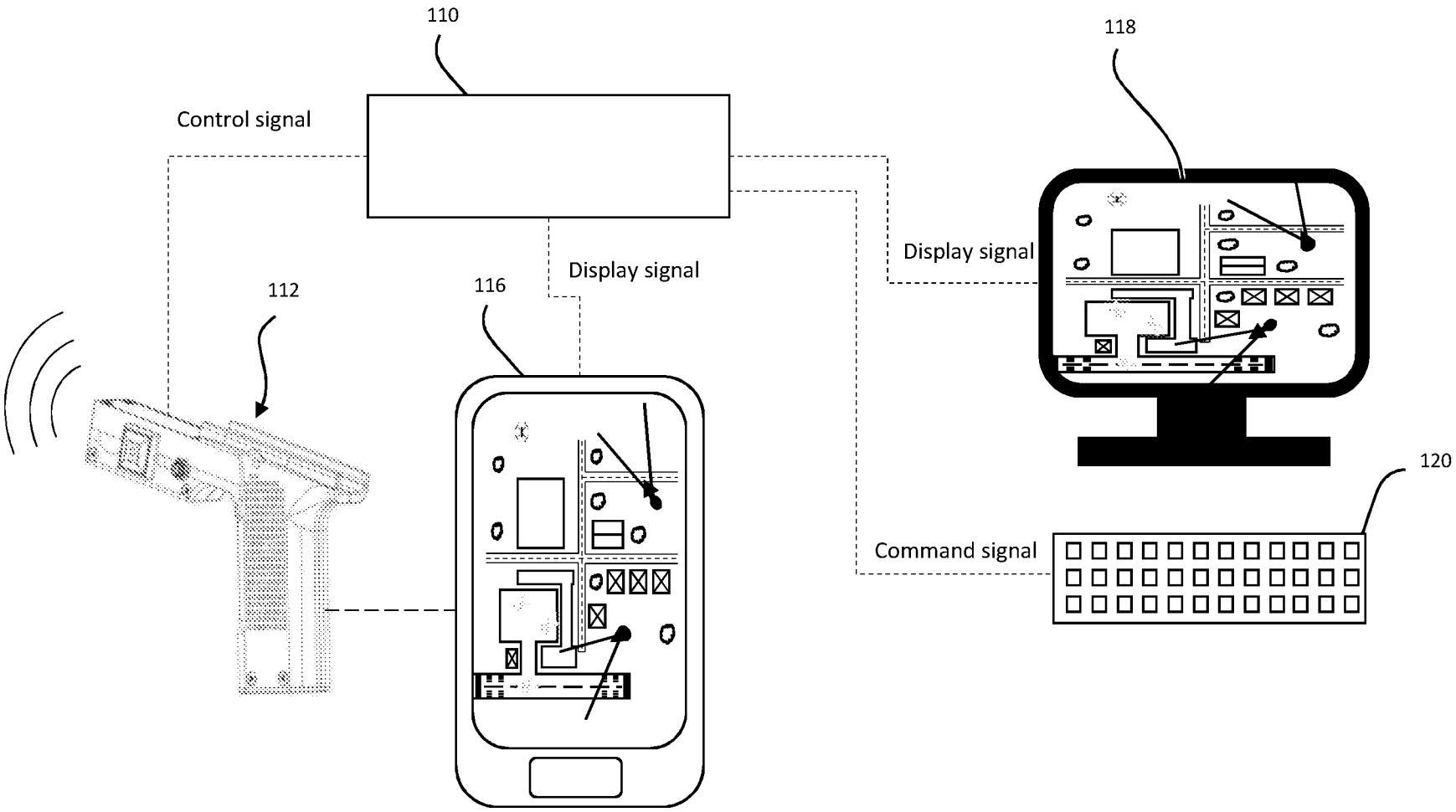
FIG. 2 shows a system according to an embodiment of the present disclosure.

An example of an embodiment in which commands may be transferred to the operators to one or more counter measure effectors is shown in FIG. 2. FIG. 2 shows a controller 110 that is connected, by wire or wirelessly, with a first display device 118, and a second display device 116. The controller 110 may have a processor that is configured to provide the display signal discussed above to both display devices 116, 118 at the same time. The first display device 118 may be located in a command office, whereas the second display device 116 may be carried by the operator of a counter measure effector 112. The second display device 116 may include another processor and be connected to the counter measure effector 112 either by wire or wirelessly. Alternatively, or additionally, the controller 110 may also be connected to the counter measure effector 112.

The controller 110 may receive command data from a centralised command office. In particular, the controller 110 may be connected to an input device 120 located within the command office. On the basis of the display signal shown on the first display device 118, e.g. a monitor within the command office, a command personnel may consider the current situation in the field and provide command signals to the controller by means of the input device 120, e.g. a keyboard. Of course, it should be understood that the input device 120 may have any form and may also combined with the first display device 118, such as by means of a touch screen panel. After reviewing the situation in the field, the commander in the command office may decide on a desired action to be taken by one or more of the field operators and instruct them accordingly by means of command signals provided to the controller 110 via the input device 120. In the embodiment shown in FIG. 2, the command signals comprise user inputs provided to the controller 110 via the user input device 120.

On the basis of the one or more command signals, the processor may generate a display signal for displaying a desired action on the second display device 116. A copy of this display signal may also be provided to the first display device 118 to verify the command provided to the operator.

The processor of the controller 110 may be configured to generate a variety of display signals on the basis of the one or more command signals, a non-exhaustive list of which is shown below:

In one example, the command signal may comprise frequency data representative of a desired frequency band desired to be emitted by the at least one effector in response to the target UAV. In other words, the commander in the control office may communicate a suitable/desired frequency band to the operator in the field via the command signal. In this example, the display signal generated by the processor may cause the second display device 116 to inform the operator of the desired frequency band to be used when engaging the target UAV. The desired frequency band may be communicated to the operator via the second display device 116 in the form of a pop-up notification or by highlighting one of a list of predetermined frequency bands that are continuously displayed on the mobile, second display device 116, for example. Such command signals comprising effective frequency data may be used to generate a display signal that is forwarded to each of the operators in the field and used to inform them, simultaneously, about the most suitable frequency band to be used.

In another example, the command signal may comprise effector displacement data representative of a desired change in location and/or orientation of the effector 12. The display signal generated by the processor upon receipt of such a command signal will indicate to the user of the second display 116 how to move the counter measure effector. It is appreciated that this information may be provided to the operator in various ways. In one example, arrows may be provided on the mobile, second display device 116 that indicate how the operator should turn the counter measure effector. Alternatively, or additionally, the display signal may cause certain points on the map to be highlighted to the operator of the counter measure effector, thereby showing the operator where to go next, e.g. in an attempt to engage the target UAV. If the controller 110 is connected to a plurality of second display devices carried by operators of various counter measure effectors, the commander may be able to provide different commands to each of the operators. In this example, the processor is configured to generate different display signals for each of the mobile display devices carried by the counter measure effector operators. Accordingly, the display signals provided to the various operators may indicate desired changes in location and/or orientation that may be used in an attempt to engage, e.g. surround, a target UAV.

In yet another example, the command signals may comprise effector activation data representative of a desire to activate the at least one effector. As will be described in more detail below, it may not always be desirable to activate a counter measure effector as soon as the target UAV is within reach. Similarly, the operator of the counter measure effector may not always see the target UAV despite the target UAV being within the field of effect of their counter measure effector. In such situations, it is beneficial for the commander to be able to communicate with the operators within the field when their respective their counter measure effector should be activated. To this end, the commander may provide a command signal to the controller 110, which will generate a corresponding display signal that may then be sent to one or more of the second display devices 116. This display signal may then prompt the operator of the respective their counter measure effector to trigger emission of electromagnetic radiation. In one example, such a display signal may generate a pop-up notification prompting the operator to activate their counter measure effector. In yet another alternative, such effector activation data may be used by the processor of the controller 110 to generate a control signal (e.g. an activation signal) for automatically triggering electromagnetic radiation by the counter measure effector 112. In this example, the command personnel is able to remotely activate the counter measure effector 112.

Each of the above command signals provided to the controller 110 via a centralised command office may be used to strategically control the actions of one or more of the operators within the field. This has a significant advantage over existing solutions which are not able to coordinate actions of various operators within the field.

In some embodiments, the processor of the controller 110 may also be configured to adjust one or more settings of the at least one counter measure effector 112 on the basis of the command signals received, e.g. from the input device 120. In one example, when the one or more command signals comprise effector frequency data, the processor of the controller 110 may generate a control signal for automatically setting the desired frequency band represented by the effector frequency data on the at least one counter measure effector 112. To this end, the controller 110 may be directly connected to the counter measure effector 112, e.g. via a wireless connection. Generally, it should be understood that the controller 110 may be a centralised controller which is arranged remote from the first and second display device 116, 118 and the counter measure effector 112. Alternatively, however, the controller 110 could also be an integral part of any of the first display device 118, the second display device 116, or the counter measure effector 112.

Figure 3:
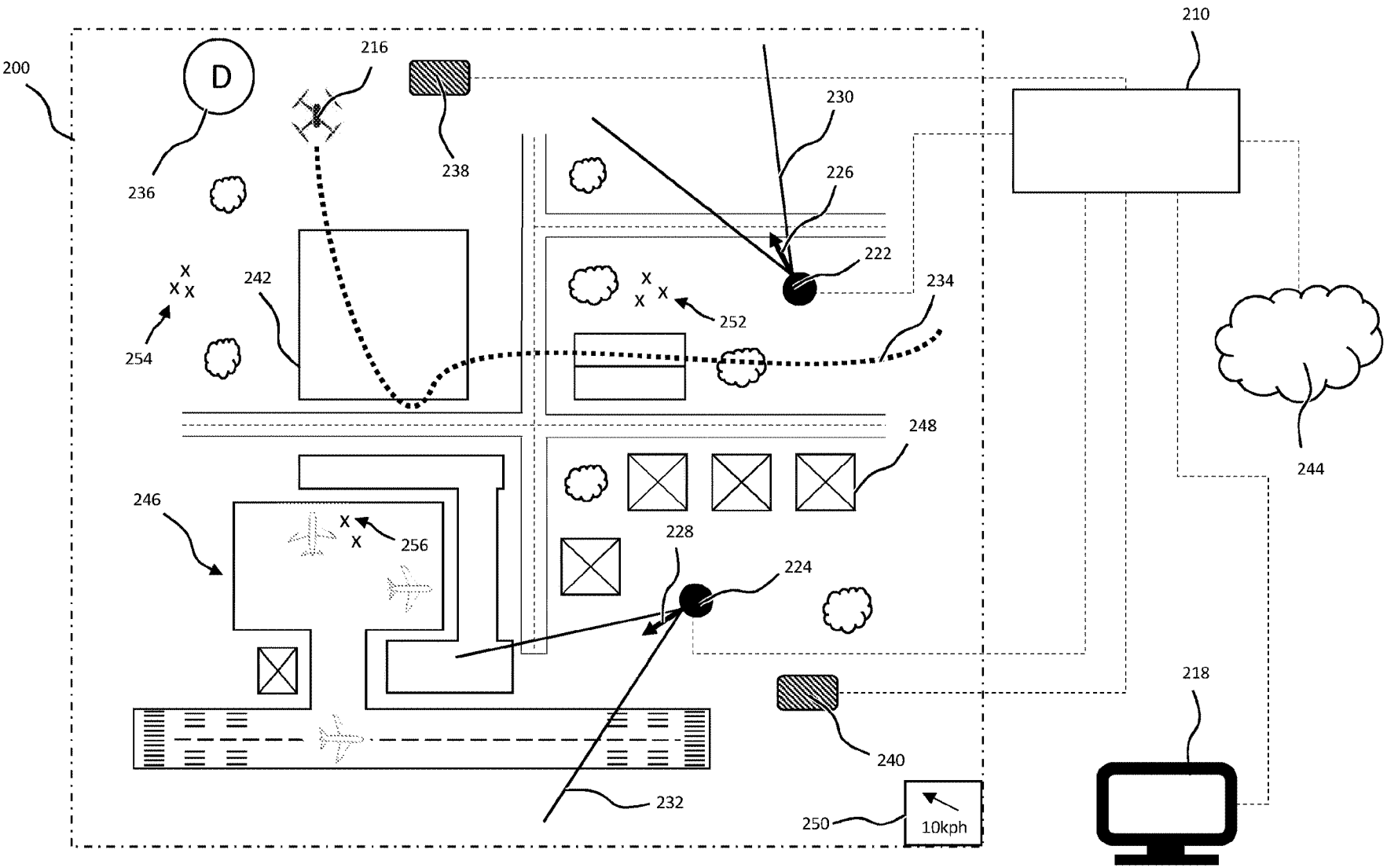
FIG. 3 shows a controller according to another embodiment of the present disclosure.

Turning to FIG. 3, there is shown a schematic image that may be shown on a display device, in response to the display signal generated by the controller. Similar to the images resulting from the display signals discussed with reference to FIGS. 1 and 2, the image 200 shown in FIG. 3 may be displayed on one or more display devices that may include an integral controller and/or may be connected to a remote controller, such as the exemplary controller 210 shown in FIG. 3. One such display device 218 is shown in FIG. 3. This display device 218 may be a display device that is located in a remote office or carried by an operator of a counter measure effector. In the exemplary image 200 created by the display signal generated by the processor, the target location, counter measure effector position, orientation and field of effect are overlaid with environmental data that will be explained in more detail below. The processor may be configured to overlay the environmental data with the aforementioned data to allow the use, e.g. a remote commander or the effector operator, to take into consideration the urban and/or natural environment surrounding the target UAV and the operators of the counter measure effectors respectively. In the following, references to parts of the image 200 will be described with reference to the object itself, but it should be understood that image 200 is, of course, only a display representation of the real object, such as the buildings and target UAV represented in the image 200.

As explained with reference to FIG. 1 above, the processor of the controller 210 may determine, on the basis of the target position data, the effector position data, and the effector orientation data, relative positions of the one or more counter measure effectors 222, 224 and the target UAV 216 with respect to each other. In the example FIG. 3, the processor of the controller 210 may generate a display signal that shows the positions of these objects in a two-dimensional coordinate system. In addition, the controller 210 may further include an arrow for each counter measure effector 222, 224, showing the orientation 226, 228 of the respective counter measure effectors 222, 224. On the basis of the effector position data and the effector orientation data, the processor of the controller 210 may also determine a field of effect 230, 232 of each counter measure effector 222, 224 and illustrate the latter as two-dimensional field of effect cones in the image 200.

In contrast to the embodiment described with reference to FIG. 1, the image 200 of FIG. 3 further includes information about the surrounding urban and/or natural environment. The processor of the controller 210 is configured to overlay the coordinate system discussed above with such environmental data that is representative of characteristics of the environment surrounding the target UAV and/or the counter measure effectors 222, 224. The processor may only consider environmental data, such as the urban environment (e.g. a satellite map) within the vicinity of the target UAV and the counter measure effectors 222, 224.

The processor may gather environmental data that relates to an area that encompasses the location of the target UAV 216, and both counter measure effectors 222, 224. In the exemplary image 200 of FIG. 3, this area may be a rectangular area surrounding the target UAV 216 as well as the two counter measure effectors 222, 224. The processor of the controller 210 may calculate a central point between the location of the target UAV 216 and the counter measure effectors 222, 224 and create a display signal that includes environmental data up to a predetermined distance from said central point. In the example of FIG. 3, the display signal is based on environmental data that spans the rectangular space shown as the image 200, around said central point. The environmental data, on the basis of which the processor generates the display signal, may change continuously as the target UAV 216 and/or the counter measure effectors 222, 224 move.

The processor of the controller 210 may be configured to receive a variety of environmental data, a non-exhaustive list is represented below:

In one example, the environmental data may comprise elevation data representative of ground elevations surrounding the target UAV. For example, these ground elevation data may include elevations in metres above sea level for the area concerned. The processor of the controller may use such elevation data to generate a topographic map that may be overlaid with the position of the target UAV, and the position, orientation, and field of effect of the at least one counter measure effector. Although not shown in the image 200, such a topography map be displayed on one or more of the display devices, e.g. the display device 218.

The environmental data may comprise building data representative of type, location, and dimensions of buildings. The processor of the controller 210 may download such information from a remote server, such as the Cloud server 244. In particular, the processor of the controller 210 may download a city map of the area concerned and generate a display signal for displaying the building data on a display device 218. In the example of FIG. 3, such building data may include the location and dimensions of a hospital building 242, the location and dimensions of an airport 246 as well as the location and dimensions of residential homes 248.

The environmental data may also comprise wind data representative of wind speeds. The processor of the controller 210 may be able to download such wind data from a remote server, such as the Cloud server 244. The processer may be configured to average the wind conditions across the area surrounding the target UAV 216 and the counter measure effectors 222, 224. The controller may then generate a display signal for showing the average wind condition 250 on a display device within image 200. The wind condition 250 may include the average direction and speed of the wind within the area concerned (i.e. the area surrounding the target UAV 216 and the counter measure effectors 222, 224).

The processor of the controller 210 may determine, on the basis of the building data, a display signal that provides an indication of the type of building concerned. This may be beneficial because certain types of buildings, such as the hospital 242, may not immediately be obvious from a two-dimensional image, such as the image 200 shown in FIG. 3. In one example, the processor might act to colour-code the types of buildings in an appropriate manner. For example, and as will be explained in more detail below, building types that must not be subjected to electromagnetic radiation by the counter measure effectors, e.g. the hospital 242 or the airport 246, may be labelled as such by the processor, e.g. by appropriate colouring. Other buildings that will not be influenced by the electromagnetic radiation of the counter measure effectors 222, 224 may be labelled differently, e.g. with a different colour.

In order for the processor to label the different types of buildings appropriately, the processor may have access to a database that defines the type of buildings that are not to be subjected to electromagnetic radiation from counter measure effectors. On the basis of the building data, the processor may identify the type of building of each of the buildings within the concerned area compare them to a listing of "radiation sensitive" (e.g. a radiation sensitivity list) building within the above database and generate a display signal that highlights the buildings that may be affected by electromagnetic radiation.

In some embodiments, certain building types will only be affected by certain frequency bands. Accordingly, it will be appreciated that the processor may change the display signal, e.g. the colouring of the buildings, depending on the frequency band selected for the counter measure effectors 222, 224. For example, if by default, a first frequency band is selected that does not affect the hospital 242, the processor will generate a display signal that does not highlight the hospital 242 in image 200. However, as soon as the frequency band of one or more of the counter measure effectors 222, 224 is changed to a different, second frequency band, the processor may be triggered to generate a new display signal on the basis of the new selected frequency band. If the above radiation sensitivity list indicates that the hospital 242 is affected by the second frequency band, the new display signal generated by the processor will then result in an image that highlights the hospital building 242. In other words, the processor may be configured to highlight buildings not to be subjected to radiation from the counter measure effectors 222, 224, on the basis of the building data, the radiation sensitivity list and the frequency band selected. It will be appreciated that this may result in different buildings being highlighted for the purposes of the two counter measure effectors 222, 224, if the first and second counter measure effectors 222, 224 use different frequency bands.

The environmental data may comprise civilian position data representative of the presence of civilians. The processor may use the civilian position data to generate a display signal for displaying the location of civilians within the concerned area. In image 200 of FIG. 3, three exemplary groups of civilians 252, 254, 256 are shown. The civilian position data may be retrieved by the processor of the controller 210 via satellite images or other camera footage of the concerned area. Alternatively, or additionally, the operators of the counter measure effectors 222, 224 may be able to input civilian position data as and when civilians are sighted within the relevant area. To this end, each of the operators within the field may have access to an input device for providing the civilian position data to the controller 210. Such input devices may be a touch screen panel of a mobile display device, such as a second display device 116 explained with reference to FIG. 2. For the avoidance of doubt, radiation emitted by the counter measure effectors conforms to EU standards for occupational and public radiation exposure limits. However, as will be described in more detail below, drones potentially falling form the sky after being subjected to the electromagnetic radiation may be dangerous to human health and thus civilian involvement must be considered when targeting certain types of UAVs.

An operator, such as a commander within a remote office may use one or more of the environmental data discussed above to consider further steps in engaging with the target UAV 216. In particular, the environmental data may help the operator to determine which of the counter measure effectors and thus their respective operators are best suited to target the UAV 216. The commander may not only consider the distance but also potential obstacles and buildings sensitive to electromagnetic radiation when deciding on the most suitable counter measure effector/operator to engage with the target UAV 216.

The commander may also determine, on the basis of the environmental data represented within the image 200, when and where it is safe to interfere with the target UAV 216 via the counter measure effectors 222, 224. For example, the operator may calculate or estimate a drop location 236 that is representative of a location to which the target UAV 216 will drop when being disabled by at least one of the counter measure effectors 222, 224. In considering the drop location, the operator may use their experience together with the wind conditions 250 and/or the elevation data displayed on the display device 218. The commander may then decide if is safe to disable the target UAV 216 at a particular moment.

In an alternative embodiment the processor of the controller 210 may be configured to automatically determine, on the basis of the environmental data and the target position data, such a drop location 236. To this end, the processor may calculate a predicted drop location 236 by calculating the flight height (altitude) of the target UAV 216 with reference to the ground below. For example, the processor may determine, on the basis of the target position data, the altitude of the target UAV 216 above sea level. As described above, such target position data may be provided by one or more radar or lidar sensors. The processor may then, on the basis of the environmental data (e.g. the elevation data), determine the elevation above sea level of the ground below the target UAV 216 and subtract the ground elevation from the altitude of the target UAV. This subtraction will result in an altitude of the target UAV 216 above ground at its current location. The processor may then calculate a drop time, which is representative of the time it takes for the target UAV 216 to drop to the ground surface below after deactivation. Based on the drop time, the processor may then estimate the effect of the wind conditions 250 (part of the wind data) to estimate the drop location 236 shown in FIG. 3.

As is schematically derivable from FIG. 3, the processor of the controller 210 may be configured to generate a display signal for displaying the drop location 236 within image 200 on one or more display devices, such as display device 218. It should be understood that the drop location 236 is a dynamic parameter that will change with changing environmental conditions as well as a change in location of the target UAV 216. Accordingly, the processor may be configured to continuously update the drop location 236 on the basis of the environmental data and/or the target position data.

In some embodiments, the user and/or the processor may determine no-drop zones. The no-drop zones may be representative of areas surrounding the target UAV in which a drop/landing of the target UAV could cause damage to structures or human health.

In one embodiment, the processor may use the environmental data, e.g. the building data, to determine one or more no-drop zones. In particular, as described above, the processor may be configured to determine areas within the map that could be damaged by a dropped UAV. In one example, such areas could be areas with the presence of civilians, such as areas 252, 254, 256 shown in image 200. Other areas could be particularly vulnerable buildings, especially if the target UAV is expected to be equipped with a payload. In one example, the processor may be configured to determine each of the buildings shown in FIG. 3 as a no-drop zone. As may be appreciated, this assessment will also require the controller 210 to be provided with a type of target UAV 216 concerned. Various sensors could be used to determine the type of target UAV 216. The processor may be configured to generate a display signal for displaying the no-drop zones on each of the one or more display devices within the counter measure system. Alternatively or additionally, it may be possible for a commander or operator to manually determine no-drop zones, e.g. by selecting certain building as no-drop zones and/or by marking any chosen area on the map as a no-drop zone.

As mentioned above, in some embodiments, the processor of the controller 210 may be configured to automatically determine the drop location 236. In such examples, the processor of the controller 210 may be configured to compare the drop location with the above one or more no-drop zones. In particular, the processor of the controller 210 may determine if the drop location 236 falls within or overlaps with one or more of the no-drop zones. If the drop location falls within or overlaps with one or more of the no-drop zones, the controller may determine a drop warning signal and generate a corresponding display signal for displaying, on the display device, the drop warning signal. In one example, the display signal could cause the display device to show a pop up notification to inform the operator (e.g. a field operator or the commander) that disabling the drone at this moment in time may cause damage to building structures and/or human life. In one example, the processor of the controller may generate a drop warning signal configured to change the appearance of a scope of the counter measure effector. In one embodiment, the optical system of the scope may comprises a reticule configured to be illuminated in different colours. In particular, the scope may include a first LED pointer illuminating the centre of the reticule in a first colour during normal operation, and a second LED pointer illuminating the centre of the reticule in a second colour when a drop warning signal is generated by the processor. This change in appearance of the scope has the advantage that the operator can observe the drop warning signal without having to take their eye off the target UAV. Of course any other change in appearance is also feasible. Alternatively, or additionally, the processor of the controller 210 may determine an audible warning on the basis of the drop warning signal.

Alternatively, or additionally, the processor of the controller may be configured to temporarily deactivate the counter measure effectors 222, 224 if the drop location overlaps with or falls within one of the no-drop zones. In this context, the term "temporarily" means that the processor may be configured to deactivate the at least one counter measure effector 222, 224 as soon as an overlap between the drop location 236 and one or more of the no-drop zones occurs. The controller may then continue comparing the drop location with the one or more drop zones and reactivate the counter measure effector(s) 222, 224 as soon as the comparison result indicates that there is no longer an overlap.

As indicated above, some of the buildings and/or vehicles within the vicinity of the counter measure effectors 222, 224 and the target UAV 216 may be sensitive to the electromagnetic radiation of the counter measure effectors 222, 224. Such buildings and/or vehicles may be automatically highlighted in an image 200 by the processor of the controller 210, as described above. Alternatively, the operator of the counter measure system may manually determine, which parts of the relevant area are sensitive to the electromagnetic radiation of the counter measure effectors 222, 224. Such buildings and/or vehicles may then be determined as no-jam zones. Accordingly, the processor may generate a display signal, in which the no-jam zones represent areas surrounding the target UAV that should not be subjected to electromagnetic radiation emitted, in use, by the at least one counter measure effector 222, 224.

As regards other vehicles, such as aeroplanes, that may also be sensitive to the electromagnetic radiation of the counter measure effectors 222, 224, it will be understood that the corresponding no-jam zones may be dynamic areas when the corresponding vehicle is in motion. To this end, the processor of the controller 210 may be configured to receive vehicle position data representative of a position of vehicles that are sensitive to the electromagnetic radiation of the counter measure effectors 222, 224 and continuously update the no-jam zones on the image 200 accordingly.

As briefly described above, buildings that may be sensitive to electromagnetic radiation by the counter measure effectors 222, 224 may be hospitals, airports, or any other building in which the use of electronic devices is essential. The same applies for vehicles that must communicate with remote devices, e.g. on a radio frequency basis.

The automatically or manually defined no-jam zones will be represented on one or more display devices. For example, the controller 210 may be configured to generate a display signal for displaying, on the display device 218, the one or more no-jam zones. In the image 200 shown in FIG. 3, such no-jam zones may be defined as the hospital 242 and the entire airport 246. Additionally, the location of each of the aeroplanes schematically represented in image 200 may be shown as no-jam zones. The no-jam zones represented in the display signal shown on the display device 218 may be used by a commander within the command office to instruct the operators of the counter measure effectors appropriately. For example, the commander may instruct the operators in the field to not engage the target UAV for as long as the field of effect cone represented on the display 218 overlaps with one or more no-jam zones.

In an alternative embodiment, the processor of the controller 210 may be configured to automatically determine when the field of effect of the counter measure effectors 222, 224 overlaps with one or more no-jam zones. To this end, the processor may be configured to compare the no-jam zones with the field of effect 228, 230 of the at least one counter measure effector 222, 224. If the field of effect 228, 230 of one or more of the counter measure effectors 222, 224 overlaps with one or more of the no-jam zones, the processor may determine an interference warning signal. In one example, the processor may be configured to generate a display signal for displaying, on the display device 218, the interference warning signal. Such an interference warning signal may be a pop-up notification indicating that triggering a particular counter measure effector 222, 224 may cause inadvertent interference between the electromagnetic radiation emitted by the counter measure effector 222, 224 and one or more sensitive buildings/vehicles. In another example, the processor may generate an interference warning signal configured to change the appearance of a scope of the counter measure effector, as discussed above. Alternatively, the interference warning signal may be forwarded by the processor to a speaker device for audibly warning the commander and/or one or more of the operators. In one embodiment, the speaker could be part of a mobile display device, such as the second display device 116 shown in FIG. 2 that is carried by the operators of the counter measure effectors 222, 224.

In yet another embodiment, the processor may be configured to temporarily deactivate each counter measure effector (here 224) if the field of effect of said the counter measure effector overlaps with one or more of the no-jam zones (e.g. the airport 246).

It will be understood that the interference warning signal is preferably only provided to the display devices carried by the operators of the counter measure effector 222, 224 that may potentially cause the inadvertent interference. In the example of FIG. 3, therefore, the display signal for displaying the interference warning signal may be transferred by the processor to the display device carried by an operator of the second counter measure effector 224 only. This is because in the example of FIG. 3, only the second counter measure effector 224 has a field of effect 232 that overlaps with a sensitive structure, such as the airport 246. The field of effect 230 of the first counter measure effector 222, however, it does not overlap with any no-jam zones. Accordingly, the display signal for displaying the interference warning signal may not be forwarded to the display device carried by the operator of the first counter measure effector 222, in this example. If the display signal is transferred to a display device 218, which is located in a centralised command office, then the processor may be configured to specify which of the counter measure effectors 222, 224 is likely to cause inadvertent interference. Of course, the above may also apply to audible interference warning signals, in which case the signals are only transferred to the counter measure effector 222, 224 that is directed towards a sensitive building/vehicle.

It will be appreciated that determination of the interference warning signal is a continuous loop, in which the processor repeatedly compares the no-jam zones with the changing field of effect 228, 230 of the counter measure effectors 222, 224. The interference warning signal may, therefore, change over time, as the field of effect of the counter measure effectors 222, 224 moves towards and away from sensitive buildings and/or vehicles.

The processor of the controller 210 may be configured to compare the position of the target UAV 216 with the field of effect 230, 232 of the counter measure effectors 222, 224. If the position of the target UAV 216 falls within the field of effect 230, 232 of one of the two counter measure effectors 222, 224, the processor of the controller 210 may take automatic action. In one embodiment, the processor may inform the operator that the target UAV is within the field of effect of one or more of the counter measure effectors 222, 224. For example, if the target UAV 216 is within the field of effect 230 of the first counter measure effector 222, the processor may inform the operator of the first counter measure effector 222 and/or a commander in the command office accordingly. To this end, the processor may be configured to provide a status signal, e.g. in the form of a display signal, to the display device connected to the first counter measure effector 222 (not shown) and/or the display device 218 located in a remote command office. Of course, the status signal may also be an audible signal that is provided to either the operator of the first counter measure effector 222 or the commander within the command office. In some embodiments, the processor may also provide the same status signal to the second counter measure effector 224 informing the operator of the second counter measure effector 224 that the target UAV 216 is currently within the field of effect 230 of the first counter measure effector 222.

Alternatively, or additionally, the processor of the controller 210 may be configured to automatically activate the relevant counter measure effector 222, 224. For example, if the target UAV 216 is within the field of effect 230 of the first counter measure effector 222, the processor may determine an actuation signal and provide the actuation signal to the first counter measure effector 222 for automatically triggering emission of electromagnetic radiation towards the target UAV 216. According to this embodiment, the operators of the counter measure effectors 222, 224 no longer are required to manually trigger the emission of the electromagnetic radiation. Rather, the processor may cause the counter measure effectors 222, 224 to emit electromagnetic radiation automatically as soon as the target UAV 216 enters the field of effect 230, 232 of the counter measure effectors 222, 224. Of course, the controller may be configured to check, beforehand, that the field of effect 230, 232 of the counter measure effector to be activated does not overlap with any no-jam zones and/or that the drop location 236 does not fall within or overlap with one or more of the no-drop zones.

Still referring to FIG. 3, there are shown sensors 238, 240 arranged within the vicinity of the target UAV 216. Both sensors 238, 240 are connected, preferably wirelessly, to the controller 210 so as to provide the processor with relevant data, particularly about the target UAV 216. The two sensors 238, 240 are, therefore, target sensors, such as the target sensor 16 described with reference to FIG. 1. In one example, the first sensor 238 may be a sensor for determining the position of the target UAV 216. Some examples include radar or lidar sensors that may determine the position of the target UAV across a large area. The first target sensor 238 may provide the processor of the controller 210 continuously with corresponding target position data.

On the basis of the target position data, the processor may be configured to determine the position of the target UAV over time and calculate the flight path of the target UAV 216. The processor of the controller 210 may be configured to generate a display signal for displaying the flight path 234 of the target UAV 216 on the display device 218, as shown in the exemplary image 200 of FIG. 3. The flight path 234 may then be used by the operator to predict the further trajectory of the target UAV. If the operator is a commander in a command office, the commander may then instruct the field operators carrying the counter measure effectors 222, 224 appropriately to intersect the predicted further flight path of the target UAV 216.

The second target sensor 240 may be a radio frequency sensor. The second sensor 240 may, therefore, be able to determine the operating frequency/the communication frequency used by the target UAV 216. The second sensor 240 may provide this frequency information continuously to the processor of the controller 210 in the form of target frequency data. On the basis of the target frequency data, the processor may be configured to determine a suitable frequency band to be emitted by the counter measure effector when activated. To this end, the processor may compare one or more values of the target frequency data with the frequency bands available to be emitted by the counter measure effectors 222, 224. In this way, the processor may determine into which frequency band the operating/communicating frequency of the target UAV 216 falls. The processor of the controller 210 may then inform the operator of the system accordingly. This may be done via a display signal generated by the processor for displaying, on the display device 218, the suitable frequency band.

It will be understood that the available frequency bands could be emitted by the counter measure effectors 222, 224 depend on the type of counter measure effector in use. Accordingly, the processor may be able to retrieve model information from the first and second counter measure effectors 222, 224 in order to access effector frequency range data representative of frequency bands available to be emitted by the counter measure effectors 222, 224. Such counter effector frequency range data may be stored in a memory of the controller 210 or be accessible via a remote server, such as the Cloud server 244.

On the basis of the frequency band information provided to the operator by the processor, the operator may then manually select the frequency band to be emitted by the counter measure effectors 222, 224. Of course, the frequency band could also be set manually from a remote command office, e.g. on the basis of frequency band information displayed on display within the remote command office. Alternatively, the processor may automatically set the suitable frequency band of the counter measure effectors 222, 224 via a suitable control signal.

Figure 4B:
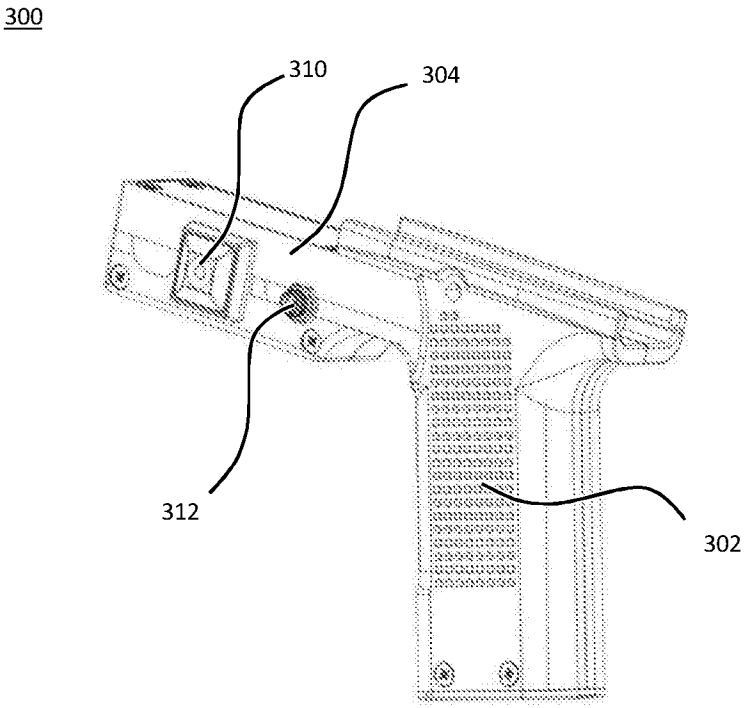
FIG. 4B shows a left-side perspective view of the counter measure effector shown in FIG. 4A.
Figure 4A:
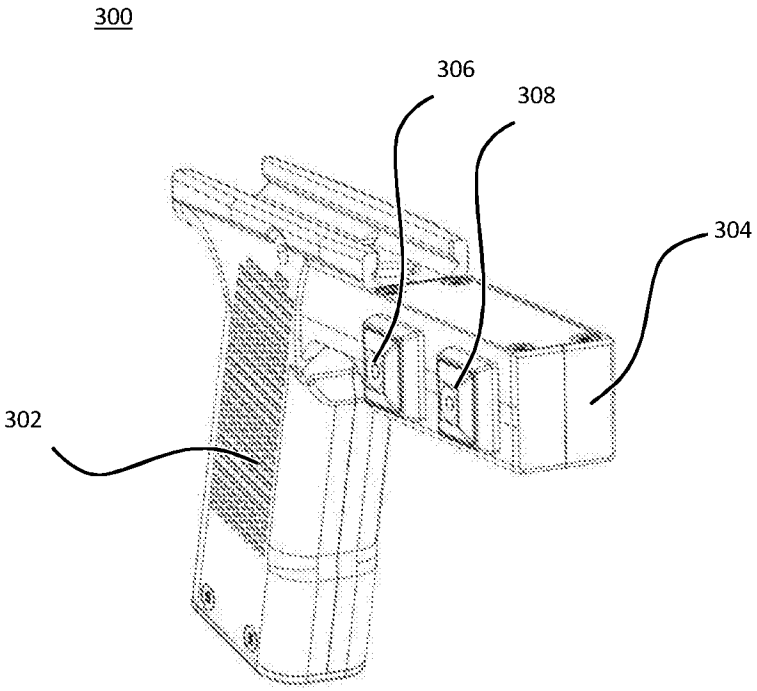
FIG. 4A shows a perspective right-side view of a counter measure effector.

Turning to FIGS. 4A and 4B, there is shown an embodiment of a counter measure effector according to an embodiment of the system of the present disclosure. FIG. 4A shows a perspective right-side view of the counter measure effector 300. FIG. 4B shows a perspective left-side view of the counter measure effector 300.

As will be appreciated, the counter measure effector 300 is substantially pistol shaped. However, it should be understood, while it is ideal for handling purposes (e.g. pointing at the target UAV), this pistol shape may not always be employed. The counter measure effector 300 comprises a handle portion 302. At an upper end of the handle portion 302 and emitter portion 304 extends at an obtuse angle with respect to the handle portion 302. Although this is not shown in FIGS. 4A and 4B, the emitter portion 304 may include a radio frequency emitter for creating the electromagnetic radiation, in use.

The counter measure 300 comprises a plurality of frequency selectors 306, 308, 310, particularly frequency selector buttons. The frequency selectors 306, 308, 310 can be used by the operator to select a suitable frequency band to be emitted by the counter measure effector 300 when activated. In some embodiments, the frequency selectors 306, 308, 310 when pressed, may select a predetermined frequency band and, at the same time, trigger emission of the electromagnetic radiation across said band. Each of the selectors 306, 308, 310 may be provided with feedback means for confirming the selected frequency band. In one example, the feedback means may be provided by selector buttons that give a haptic feedback when the selectors 306, 308, 310 are depressed. Alternatively, or additionally, the selectors 306, 308, 310 may include visual indicators, such as LED lights that are activated when the selectors 306, 308, 310 are pressed. The light indicators may remain active for as long as electromagnetic radiation of the selected frequency is emitted by the counter measure effector 300. The selectors may be configured to stop the counter measure effector 300 from emitting radio frequency signals as soon as the selector 306, 308, 310 is pressed again.

The counter measure effector shown in FIGS. 4A and 4B further comprises a data port 312. The data board shown in FIG. 4B is a co-axial cable connector. The data port 312 may be used for communication of data between the counter measure effector 300 and the controller of the system.

The counter measure effector 300 comprises an electromagnetic emitter for emitting electromagnetic radiation in a certain direction. The electromagnetic emitter may, for example, be housed within the emitter portion 304. The emitter portion 304 may be shaped to point in the direction of radiation emitted by the counter measure effector 300, when in use.

The counter measure effector 300 comprises a location sensor for determining position data representative of a position of the counter measure effector 300. One example of such a location sensor may be a GPS sensor received within housing of the counter measure effector, e.g. within the handle portion 302. The counter measure effector 300 also comprises an orientation sensor for determining orientation data representative of an orientation of the counter measure effector 300 relative to geographic cardinal directions. The orientation sensor may be a gyroscopic sensor received within the housing of the counter measure effector 300. Finally, the counter measure effector may include a communications module for transmitting the location data and the orientation data to the controller of the system.

Figure 5:
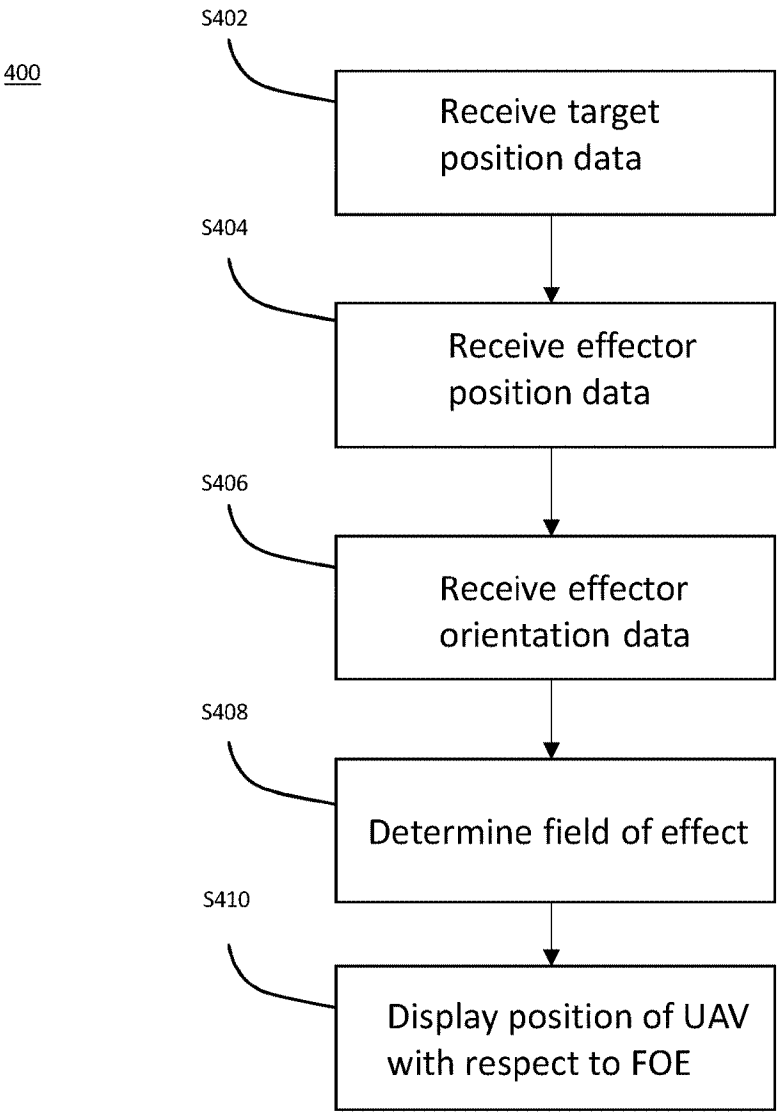
FIG. 5 shows a method of controlling a counter measure system according to an embodiment of the present disclosure.

FIG. 5 shows a schematic flow diagram of a method according to the present disclosure. The method 400 shown in FIG. 5 is for controlling a counter measure system against unmanned aerial vehicles. The method comprises a step S402 for receiving target position data indicative of a position of a target UAV.

In a second step S404, the method comprises receiving effector position data indicative of a position of at least one counter measure effector.

In a third step S406, the method comprises receiving effector orientation data indicative of an orientation of the at least one counter measure effector relative to geographic cardinal directions. It will be appreciated that the first three steps S402 to S406 may be processed in any order.

In a fourth step S408, the method comprises determining a field of effect of the at least one counter measure effector on the basis of the effector position data and the effector orientation data. The field of effect is indicative of an area covered by electromagnetic radiation emitted, in use, by the at least one counter measure effector. It should be appreciated that the fourth step S408 may be processed as soon as the effector position data and the effector orientation data are received as described in steps S404, S406. It follows that completion of step S402 is not necessary for progressing with the fourth step S408.

The method 400 comprises a fifth step, S410, for displaying, on a display device (e.g. 218, FIG. 3), the position of the target UAV with respect to the field of effect (FOE) of the at least one counter measure effector.

Although the above examples specifically referred to method of and controllers for controlling a counter measure system against UAVs, it should be understood that the present disclosure is equivalently applicable to other counter measure systems, such as systems against unmanned ground vehicles (UGV), unmanned surface vehicles (USV), or unmanned underwater vehicles (UUV). In such cases, the target sensor will, of course, be configured to determine the position of the respective unmanned ground, surface, or underwater vehicle, and forward the corresponding information to the controller as the target position data.

Moreover, while the above referred to a single target UAV and one or two counter measure effectors, it will be appreciated that the teachings of the present disclosure are equivalently applicable to any number of target UAVs and/or counter measure effectors.

The listing or discussion of an apparently prior-published document in this specification should not necessarily be taken as an acknowledgement that the document is part of the state of the art or is common general knowledge.

Preferences and options for a given aspect, feature or parameter of the disclosure should, unless the context indicates otherwise, be regarded as having been disclosed in combination with any and all preferences and options for all other aspects, features and parameters of the disclosure.

The invention claimed is:

1. A counter measure system against unmanned aerial vehicles (UAVs), comprising:
a controller comprising a display device and a processor;
at least one target sensor; and
a plurality of counter measure effectors;
wherein the processor is configured to:
receive, from the at least one target sensor, target position data indicative of a position of a target UAV;
receive, from each of the plurality of counter measure effectors:
effector position data indicative of a position of each of the plurality of counter measure effectors;
effector orientation data indicative of an orientation of each of the plurality of counter measure effectors relative to geographic cardinal directions;
receive emission range data representative of a distance and radial coverage of an emission range of each of the plurality of counter measure effectors;
receive environmental data representative of characteristics of an urban or natural environment;
determine a field of effect for each of the plurality of counter measure effectors on the basis of their respective effector position data, effector orientation data, and emission range data, said field of effect being indicative of an area covered by electromagnetic radiation emitted, in use, by the counter measure effector; and,
generate a display signal for displaying, on the display device, the position of the target UAV with respect to the field of effect of the plurality of counter measure effectors, and environmental data surrounding the target UAV.

2. The counter measure system of claim 1, wherein the processor is configured to:
receive one or more command signals representative of a desired action to be taken by an operator of the at least one counter measure effector; and
generate, on the basis of the one or more command signals, a display signal for displaying, on the display device, the desired action.

3. The counter measure system of claim 2, wherein the command signals comprise user input provided by a user of the controller.

4. The counter measure system of claim 2, wherein the one or more command signals comprise one or more of:
effector frequency data representative of a desired frequency band to be emitted by the at least one effector in response the target UAV;
effector displacement data representative of a desired change in location and/or orientation of the at least one counter measure effector; and,
effector activation data representative of a desire to activate the at least one counter measure effector.

5. The counter measure system of claim 1, wherein the processor is configured to:
determine the counter measure effector that is most suitable for taking action against the target UAV; and,
generate a display signal for displaying, on the display device, the most suitable counter measure effector.

6. The counter measure system of claim 1, wherein the processor is configured to:
receive target frequency data indicative of a communicating frequency used by the target UAV;
determine, on the basis of the target frequency data, a suitable frequency band to be emitted by the counter measure effector when activated; and,
generate a display signal for displaying, on the display device, the suitable frequency band.

7. The counter measure system of claim 6, wherein the processor is configured to:
receive counter effector frequency range data representative of frequency bands available to be emitted by the counter measure effector;
compare one or more values of the target frequency data with each of the frequency bands; and,
determine, on the basis of a comparison result, a suitable frequency band to be emitted by the counter measure effector when activated.

8. The counter measure system of claim 6, wherein the processor is configured to determine a control signal for automatically setting the frequency of the counter measure effector to the suitable frequency band.

9. The counter measure system of claim 1, wherein the display device comprises a display arranged in command office located remotely from the at least one counter measure effector and/or wherein the display device comprises a mobile display carried by an operator of the counter measure effector.

10. The counter measure system of claim 1, wherein the environmental data comprises one or more of:
elevation data representative of ground elevations;
wind data representative of wind speeds;
building data representative of type and/or location and/or dimensions of buildings; and,
civilian position data representative of the presence of civilians.

11. The counter measure system of claim 1, wherein the controller is configured to:
determine, on the basis of the environmental data, one or more no-drop zones representative of areas surrounding the target UAV in which a drop/landing of the target UAV could cause damage to structures or human health; and,
generate a display signal for displaying, on the display device, the one or more no-drop zones.

12. The counter measure system of claim 1, wherein the controller is configured to:
determine, on the basis of the environmental data and the target position data, a drop location representative of a predicted location to which the target UAV will drop when being disabled by the at least one counter measure effector; and,
generate a display signal for displaying, on the display device, the drop location.

13. The counter measure system of claim 12, wherein the controller is configured to:
compare the drop location with the one or more no-drop zones;
determine a drop warning signal if the drop location falls within one of the one or more no-drop zones; and,
generate a display signal for displaying, on the display device, the drop warning signal.

14. The counter measure system of claim 12, wherein the controller is configured to:
compare the drop location with the one or more no-drop zones; and,
temporarily deactivate the at least one counter measure effector and/or warn the operator if the drop location falls within one of the one or more no-drop zones.

15. The counter measure system of claim 1, wherein the controller is configured to:

determine, on the basis of the environmental data, one or more no-jam zones representative of areas surrounding the target UAV which should not be subjected to electromagnetic radiation emitted, in use, by the at least one counter measure effector; and generate a display signal for displaying, on the display device, the one or more no-jam zones.

16. The counter measure system of claim 15, wherein the controller is configured to:

correlate the environmental data with the field of effect of the at least one counter measure effector;

determine an interference warning signal if the field of effect of the at least one counter measure effector intersects within one of the one or more no-jam zones; and, generate a display signal for displaying, on the display device, the interference warning signal.

17. The counter measure system of claim 15, wherein the controller is configured to:

correlate the environmental data with the field of effect of the at least one counter measure effector; and, temporarily deactivate the at least one counter measure effector and/or warn the operator if the field of effect of the at least one counter measure effector intersects with one of the one or more no-jam zones.

18. The counter measure system of claim 1, wherein the controller is configured to:

determine an actuation signal if the target UAV is within the field of effect of the at least one counter measure actuator; and, provide the actuation signal to the at least one counter measure effector for actuating emission of electromagnetic radiation towards the target UAV.

* * * * *